United States Patent [19]

Mollet et al.

[11] 4,368,256

[45] Jan. 11, 1983

[54] PROCESS FOR PRODUCTION OF MASKED POSITIVE COLOR IMAGES BY THE SILVER DYE BLEACH PROCESS AND THE SILVER DYE BLEACH MATERIAL USED IN THIS PROCESS

[75] Inventors: Herbert Mollet, Tentlingen; Dieter Wyrsch, Marly, both of Switzerland

[73] Assignee: Ciba-Geigy AG, Basel, Switzerland

[21] Appl. No.: 282,687

[22] Filed: Jul. 13, 1981

[30] Foreign Application Priority Data

Jul. 22, 1980 [CH] Switzerland ..... 5588/80

[51] Int. Cl.[3] ..... G03C 7/04

[52] U.S. Cl. ..... 430/359; 430/382; 430/391; 430/393; 430/504; 430/544; 430/559

[58] Field of Search ..... 430/359, 391, 393, 504, 430/559, 544, 382, 569

[56] References Cited

U.S. PATENT DOCUMENTS

| | | | |
|---|---|---|---|
| 3,206,313 | 9/1965 | Porter et al. | 430/564 |
| 3,708,300 | 1/1973 | Luckey | 430/504 |
| 4,046,566 | 9/1977 | Marthaler | 430/359 |
| 4,082,553 | 4/1978 | Groet | 430/504 |
| 4,153,459 | 5/1979 | Neuberger et al. | 430/504 |
| 4,310,617 | 1/1982 | Mollet et al. | 430/359 |

*Primary Examiner*—J. Travis Brown

*Attorney, Agent, or Firm*—Joseph G. Kolodny

[57] ABSTRACT

Production of masked positive color images by the silver dye bleach process, by exposure of a photographic material for the silver dye bleach process, silver developing, dye bleaching, silver bleaching and fixing, optionally the silver bleaching is carried out simultaneously with the dye bleaching and/or the fixing, in a single processing bath. The photographic material used contains (a) in at least one layer, at least one first dye from which at least one undesired secondary color density is to be compensated, (b) in the layer(s) (a) and/or in a layer adjacent to this layer, (in each case) one iodide-containing silver halide emulsion associated with this dye (these dyes), (c) in at least one other layer, at least (in each case) one second dye, the main color density of which corresponds to the secondary color density (densities), to be compensated, of the first dye(s), (d) in the layer(s) (c) and/or in a layer adjacent thereto, an iodide-free silver halide emulsion associated with this dye (these dyes), or, in comparison with the emulsions mentioned under (b), a silver halide emulsion of low iodide content, and (e) in the layer(s) (c) and/or in at least one other layer which is adjacent to the layer(s) (c) and which is separated from one or more layers (a) by at least one intermediate layer, a core-shell emulsion which is free of iodide or has a low iodide content, the particles of which emulsion consist of a surface-fogged silver halide core and of an unfogged silver halide shell enclosing the latter, it being possible for this emulsion to be developed spontaneously up to the maximum density by the action of a developer, and optionally a developing retarder.

The developing rate of the core-shell emulsion and hence the masking effect can furthermore be influenced by the shell thickness of the core-shell particles and also by the sulfite content of the developer.

The developing is carried out in a developer solution which does not contain any silver-complexing agents.

21 Claims, 3 Drawing Figures

Fig. 2 TABLE

LEGEND

Figure 1:
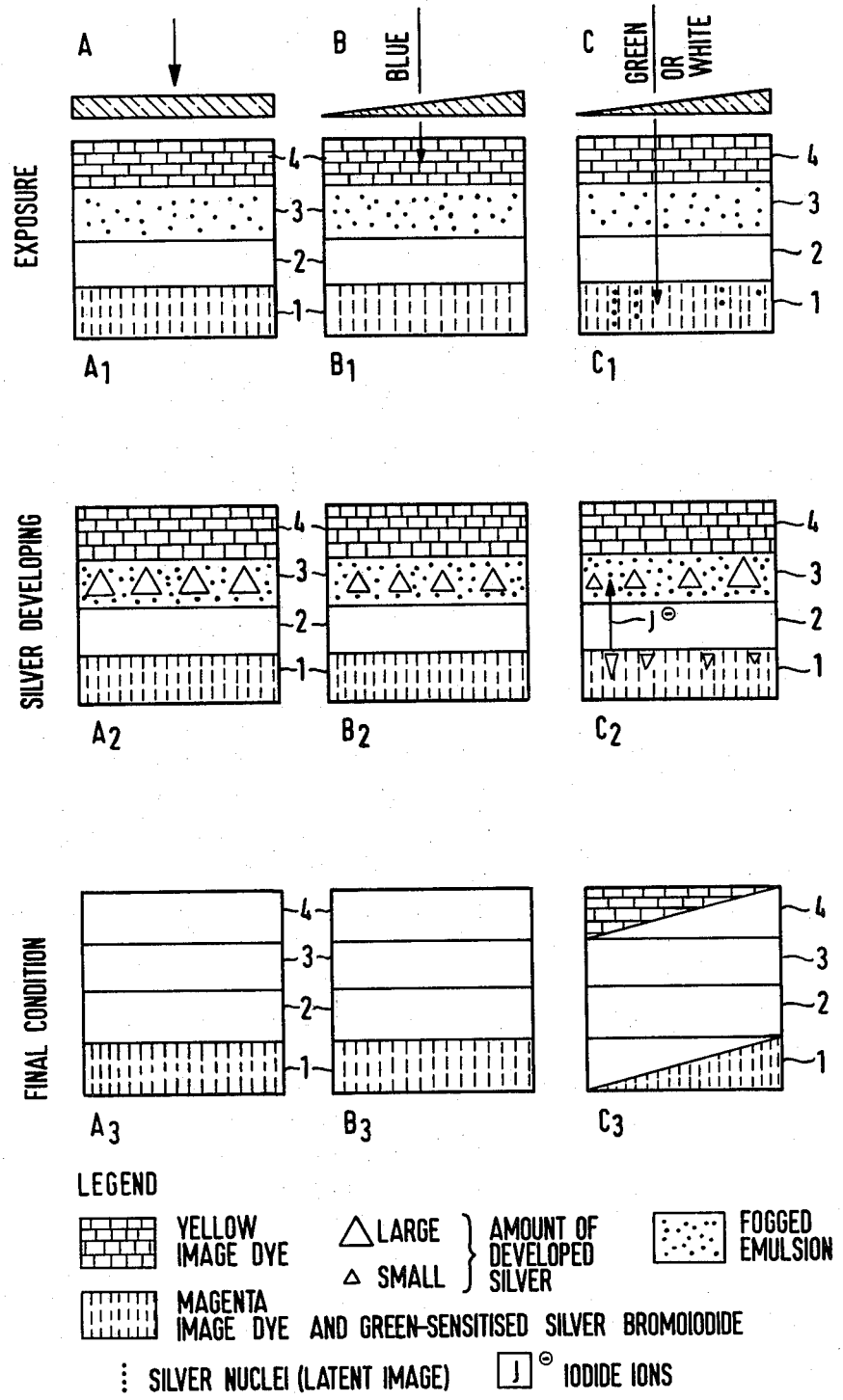

GE: YELLOW
PU: MAGENTA
BG: CYAN
MF: MASKED COLOUR(S)
$F_1, F_2, F_3$: COLOUR LAYERS
D: COVERING LAYER

NFD: SECONDARY COLOUR DENSITY
R: RED
G: GREEN
B: BLUE
SENSITISING OR ABSORPTION REGION
V: FOGGED EMULSION
T: SEPARATING LAYER
$J^{\ominus}$ ; ▼: LAYER WITH (▽ WITHOUT) AgJ

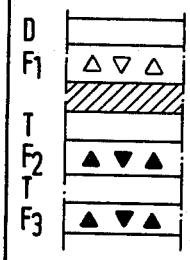

| | 1 | 2 | 3 | 4 | 5 | 6 |
|---|---|---|---|---|---|---|
| | GE | GE | PU | PU | BG | BG |
| | PU | BG | GE | BG | GE | PU |
| | BG | PU | BG | GE | PU | GE |
| MF | BG+PU | | GE+BG | | GE+PU | |
| NFD | B | | G | | R | |

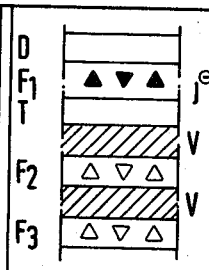

| | 19 | 20 | 21 | 22 | 23 | 24 |
|---|---|---|---|---|---|---|
| | GE | GE | PU | PU | BG | BG |
| | PU | BG | GE | BG | GE | PU |
| | BG | PU | BG | GE | PU | GE |
| MF | GE | | PU | | BG | |
| NFD | G+R | | B+R | | B+G | |

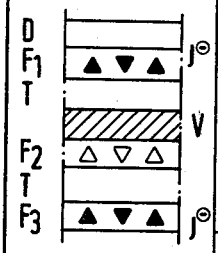

| | 7 | 8 | 9 | 10 | 11 | 12 |
|---|---|---|---|---|---|---|
| | PU | BG | GE | BG | GE | PU |
| | GE | GE | PU | PU | BG | BG |
| | BG | PU | BG | GE | PU | GE |
| MF | BG+PU | | BG+GE | | GE+PU | |
| NFD | B | | G | | R | |

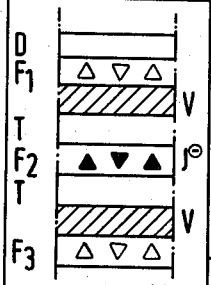

| | 25 | 26 | 27 | 28 | 29 | 30 |
|---|---|---|---|---|---|---|
| | PU | BG | GE | BG | GE | PU |
| | GE | GE | PU | PU | BG | BG |
| | BG | PU | BG | GE | PU | GE |
| MF | GE | | PU | | BG | |
| NFD | G+R | | B+R | | B+G | |

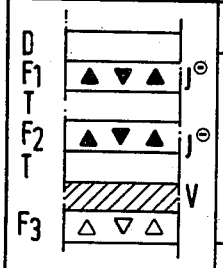

| | 13 | 14 | 15 | 16 | 17 | 18 |
|---|---|---|---|---|---|---|
| | PU | BG | GE | BG | GE | PU |
| | BG | PU | BG | GE | PU | GE |
| | GE | GE | PU | PU | BG | BG |
| MF | PU+BG | | GE+BG | | GE+PU | |
| NFD | B | | G | | R | |

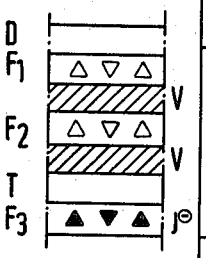

| | 31 | 32 | 33 | 34 | 35 | 36 |
|---|---|---|---|---|---|---|
| | PU | BG | GE | BG | GE | PU |
| | BG | PU | BG | GE | PU | GE |
| | GE | GE | PU | PU | BG | BG |
| MF | GE | | PU | | BG | |
| NFD | G+R | | B+R | | B+G | |

PROCESS FOR PRODUCTION OF MASKED POSITIVE COLOR IMAGES BY THE SILVER DYE BLEACH PROCESS AND THE SILVER DYE BLEACH MATERIAL USED IN THIS PROCESS

The present invention relates to a process for the production of masked positive colour images by the silver dye bleach process and to the silver dye bleach material used in this process.

Photographic processes for the production of colour images or for the reproduction of colour originals are carried out virtually exclusively according to the subtractive principle. In general, in this process, three superimposed layers, which each contain a partial image in the subtractive primary colours cyan, magenta and yellow, are used on a transparent or opaque base. It is thus possible to reproduce all colour shades within the colour space defined by the three primary colours. By suitably choosing the image dyes, the colours occurring in nature or in the original can thus be reproduced satisfactorily in respect of tonality and saturation. The prerequisite for this is a favourable mutual matching within the dye tripack and a high saturation of the individual primary colours.

Under practical conditions, however, a problem arises here, which cannot be directly overcome using simple photographic agents, namely that the dyes which are available for the reproduction of the three primary colours cyan, magenta and yellow all show, in addition to the desired absorption in one of the three complementary main colours red, green or blue, at least one other, albeit weaker, absorption region in a spectral region associated with the other two primary colours. This so-called secondary colour density does not in itself prevent the reproduction of all colour values and brightness values within the colour space; however, it has the result that a change in the colour density within a colour layer such as can be achieved by known photographic processes with the aid of a correspondingly sensitised silver halide emulsion, affects both the main colour density and the secondary colour density. This results in undesired colour shifts and saturation losses, which very considerably disturb the colour fidelity in the reproduction of an original.

Secondary colour densities are fundamentally present in all three subtractive primary colours, i.e. in the red and green in the case of yellow (main absorption in the blue), in the red and blue in the case of magenta (main absorption in the green) and in the green and blue in the case of cyan (main absorption in the red). The secondary colour densities of the magenta dyes in the blue and red, and also the secondary colour density of the cyan dye in the blue, are particularly strong and therefore troublesome. The secondary colour density of the cyan dye in the green is somewhat less troublesome and the secondary colour densities of the yellow dye in the red and green are troublesome to an even smaller extent. This has the result that in particular the reproduction of pure blue and red shades in photographic colour materials is always associated with difficulties.

There has been no lack of attempts to overcome or at least to moderate this fundamental deficiency of photographic colour materials in various ways. Because it has hitherto been impossible to find any cyan, magenta and yellow dyes without troublesome secondary colour densities, it has been necessary to achieve the object by indirect means. One of the processes known as masking comprises compensating the undesired secondary colour density of a dye, in additional layers with countergradation, in such a way that the sum of the secondary colour densities in the layer to be masked and in the masking layer remains constant independently of the particular main colour density. When applied consistently for all six secondary colour densities, this process has the result, however, that pure white shades (absence of any colour density) can no longer be obtained, but at best neutral grey shades are obtained. The process is thus suitable primarily for the production of colour negatives or colour separations in reproduction processes, i.e. processes in which the said disadvantage can be compensated again in the subsequent copying or reproduction step.

In the production of subtractive positive images by the silver dye bleach process, masking processes according to U.S. Pat. Nos. 2,387,754 and 2,193,931, for example, have been applied.

It is known from U.S. Pat. No. 2,673,800 and German Auslegeschrift No. 1,181,055 that negative colour images can be obtained by the silver dye bleach process with simultaneous application of silver complex diffusion. In these processes, the formation of the corresponding silver image by physical developing is controlled imagewise by bromide ion diffusion from a silver bromide emulsion present in an adjacent layer. A process for the production of masked images by the silver dye bleach process, as described in German Auslegeschrift No. 2,547,720, is based on a similar effect, namely the diffusion of iodide ions. In accordance with this process, a material is used in which a layer containing developing nuclei is arranged between a first layer containing a dye, the undesired secondary colour density of which is to be corrected, and a second dye, the main colour density of which corresponds to the secondary colour density of the first dye, the first dye being associated with an iodide-containing silver halide emulsion, but the second dye being associated with a silver halide emulsion which is free of iodide or low in iodide. When developing this material, a small amount of a silver halide solvent, for example thiosulfate, must be present. From the iodide-free emulsion associated with the second dye, a soluble complex is formed from the unexposed and undevelopable silver halide and is reduced to metallic silver on the nuclei of the intermediate layer. If the silver halide emulsion associated with the first dye is now exposed, iodide ions are formed in the image areas on subsequent developing and they also migrate into the nucleating layer and, in the relevant areas, prevent the accumulation of silver from the complex. A silver image, which is the counter-image of the silver image belonging to the first dye, is formed in the nucleating layer. It is used in the subsequent bleach process for bleaching the second dye, whereby the desired masking effect is obtained. A development of this process is described in German Offenlegungsschrift No. 2,831,814. Here, to increase the masking effect, a very insensitive emulsion, and if appropriate a stabiliser or developing retarder, are added to the nucleating layer. The reaction mechanism in the formation of the masking image remains the same; however, the insensitive silver halide emulsion in the nucleating layer acts as an additional supplier of silver, which also reacts with the migrating iodide ions.

The processes described in the two last-mentioned patent publications are thus based on the formation of a silver counter-image by physical developing on nuclei present, a soluble silver complex supplying the silver necessary for the build-up of the image. Both processes have proved valuable for the production of masked images by the silver dye bleach process. However, they still have certain disadvantages which are associated with the formation and enrichment of soluble silver complexes in the developer solution containing thiosulfate. Thus, it has been known for a long time, for example from the experience of complex diffusion processes, that such developer solutions become turbid with time and ultimately tend to deposit silver slurry. The vessels, the rollers used in developing machines, and finally also the photographic material itself, thus become soiled. Although it is possible to prevent this deposition of slurry, at least for a certain time, by the addition of so-called slurry inhibitors, for example certain mercaptans or organic disulfides, this represents an additional cost-increasing effort. It has moreover been shown that the silver images formed even in the presence of very small amounts of thiosulfate are more difficult to bleach and therefore necessitate the use of special bleach accelerators.

The object of the present invention is to provide a novel process for the production of masked positive colour images by the silver dye bleach process, which extensively overcomes these disadvantages which still persist.

It has been found that a masking effect can be obtained, whilst dispensing with silver complex diffusion and the resulting need for the troublesome thiosulfate in the developer solution, if the photographic materials used for the silver dye bleach process contain, instead of the nucleating layer (German Offenlegungsschriften Nos. 2,547,720 and 2,831,814), a layer with a pre-fogged silver halide emulsion which, on developing, develops spontaneously to virtually maximum density. The spontaneous developing of such an emulsion, provided it is itself free of iodide or has a low iodide content, can be influenced by migrating iodide ions in a similar way to that known from the physical developing of silver complexes on silver nuclei. In contrast to the known processes, however, this does not involve physical developing, but normal chemical developing, i.e. the silver accumulated on the developing nucleus originates not from the developer solution or the silver complex dissolved therein, but directly from the crystal which contains the latent image nucleus. For it to be possible, also in this case, to control the developing by migrating iodide ions, it is necessary to match the start and the rate of the developing to the diffusion rate of the iodide ions. This can be achieved either by a preferably substantive developing inhibitor present in the layer, or by a diffusion-inhibiting shell enclosing the fogged silver halide crystal, or by a combination of both means.

Silver halide emulsions of which the fogged silver halide crystals are enclosed by a diffusion-inhibiting shell can be produced in a particularly simple manner by the known core-shell technique.

Such emulsions are outstandingly suitable for use in a masking layer of a photographic material for the silver dye bleach process.

One object of the present invention is thus a process for the production of masked positive colour images by the silver dye bleach process, by exposure of a photographic material for the silver dye bleach process, silver developing, dye bleaching, silver bleaching and fixing, the silver bleaching being optionally carried out simultaneously with the dye bleaching and/or the fixing, in a single processing bath, in which process the photographic material contains (a) in at least one layer, at least one first dye from which at least one undesired secondary colour density is to be compensated, (b) in the layer(s) (a) and/or in a layer adjacent to this layer, (in each case) one iodide-containing silver halide emulsion associated with this dye (these dyes), (c) in at least one other layer, at least (in each case) one second dye, the main colour density of which corresponds to the secondary colour density (densities), to be compensated, of the first dye(s), (d) in the layer(s) (c) and/or in a layer adjacent thereto, an iodide-free silver halide emulsion associated with this dye (these dyes), or, in comparison with the emulsions mentioned under (b) a silver halide emulsion of low iodide content, and (e) in the layer(s) (c) and/or in at least one other layer which is adjacent to the layer(s) (c) and which is separated from one or more layers (a) by at least one intermediate layer, a core-shell emulsion which is free of iodide or has a low iodide content, the particles of which emulsion consist of a surface-fogged silver halide core and of an unfogged silver halide shell enclosing the latter, it being possible for this emulsion to be developed spontaneously up to the maximum density by the action of a developer, and optionally a developing retarder, and the developing is carried out in a developer solution which is free of silver-complexing agents.

Further objects of the present invention are the novel photographic silver dye bleach material for carrying out the process according to the invention, the use of the material for the production of positive colour images, and the positive colour images produced.

The production of core-shell emulsions has been described, inter alia, in German Offenlegungsschriften Nos. 1,597,488, 2,211,771 and 2,801,127 and in Research Disclosure 16, 345 (1977). All the customary silver halides, i.e. silver chloride, silver bromide and silver iodide, or mixed crystals of two or all three components, can be used as silver halide crystals to be enclosed. To ensure uniform growth of the shell, it is advantageous for the silver halide crystals to be as similar as possible in size. Monodisperse emulsions, such as those which can be produced by known methods, for example in cubic or octahedral habit are therefore used in particular. The production of monodisperse emulsions is described, for example, in German Offenlegungsschrift No. 1,904,148.

The silver halide shell to be applied can consist of the same silver halide as the core or of a different silver halide. The radius ratio of core to shell can also vary within wide limits, the particles suitable for the present invention being primarily those for which the shell thickness is relatively small compared with the core diameter.

Three methods in particular are usual for applying the shell to the core:

(a) The precipitation of further silver halide on top, by the simultaneous addition of soluble silver salt and a soluble halide, the precipitation conditions (concentration and rate) being chosen so that no new crystallisation nuclei are formed (for example German Offenlegungsschrift No. 2,015,070).

(b) The addition of a finely disperse silver halide emulsion, the crystals of which are substantially smaller than the crystals to be enclosed. The finely disperse crystals disappear, a shell of the material of the added finely disperse emulsion growing around the coarser crystals of the silver halide emulsion, as in Ostwald ripening (for example U.S. Pat. No. 3,206,313).

(c) Precipitation during periodic changing of the pAg value between silver excess and halide excess. Particles with a multilayer structure can be produced in this way (for example U.S. Pat. No. 3,917,485).

The core-shell technique makes it possible to carry out the customary photographic operations which effect the surface, for example ripening, fogging, sensitising or the accumulation of further substances such as stabilisers, developing accelerators and developing retarders, on the silver halide crystals to be enclosed, and thereafter to place the surface treated in this way inside the crystal by growing the shell [for example German Offenlegungsschrift No. 2,260,117 or E. Moisar and S. Wagner, Ber. Bunsengesellschaft 67, 356 (1963)].

It has been found that choosing a suitable shell thickness around the fogged core of a core-shell particle is an excellent method of delaying the start of spontaneous developing. This makes it possible to achieve a temporal correspondence with the diffusion of the iodide ions controlling the developing. Shell thicknesses of between 50 and 1,000 Å., corresponding to about 7 to 140 silver halide lattice planes, and preferably 100 to 250 Å., represent a suitable range for the process according to the invention.

Another possible method of influencing the start of developing of the core-fogged core-shell emulsions consists in choosing various concentrations of an ammonium sulfite or alkali metal sulfite in the developer solution. The kinetics of spontaneous developing can be controlled within wide limits by the sulfite concentration (2 to 100 g per liter of developer solution).

The start and the rate of the developing process can in addition be influenced by the use of substances which retard developing. Such substances can be absorbed on the fogged surface of the core before growing the shell.

Examples of suitable developing inhibitors and developing retarders are benzotriazole, 2-mercaptobenzothiazole, N-methylmercaptotriazole, phenylmercaptotetrazole, triazolindolizine and their derivatives. An important condition here is that the solubility product of the silver salt formed from the developing retarder is between that of silver chloride and that of silver iodide (c.f. A. B. Cohen et al. in Photographic Sci. and Eng. 9, 96 (1965)).

Basically all known developing retarders which satisfy this condition are suitable. However, those compounds which can be stored in a diffusion-resistant form in the photographic layers are preferably suitable. These are primarily compounds containing ballast groups, which are sparingly soluble or virtually insoluble in water. Examples of suitable compounds of this type are 5-mercaptotetrazoles which are substituted in the 1-position by preferably polynuclear aryl groups, for example naphthyl or diphenyl, and are also unsubstituted or substituted by preferably higher alkyl groups ($C_3$–$C_{18}$) or by aralkyl having at least 3, in particular 3 to 18, carbon atoms in the alkyl moiety. Phenyl and naphthyl are possible aryl groups in the aralkyl radical.

Examples of particularly suitable developing retarders are 5-mercaptotetrazoles which are substituted in the 1-position by one of the following groups: n-propyl, i-propyl, n-butyl, i-butyl, t-butyl, i-amyl, i-octyl, t-octyl, nonyl, decyl, lauryl, myristyl, palmityl, stearyl, ditert.-butyl-phenyl, octylphenyl, dodecylphenyl, naphthyl, α- or β-naphthyl or diphenyl. It is also possible to use mercaptotetrazoles not containing true ballast groups, which are not diffusion-resistant. However, in this case, care must be taken that the developing retarder does not diffuse in an undesirable direction into an adjacent layer and, for example, retard the developing of the emulsions which supply iodide ions. This can be prevented, for example, by inserting an intermediate layer. Under this condition, it is also possible, for example, to use mercaptotetrazoles which are substituted in the 1-position by the following groups: phenyl, phenyl substituted by hydroxyl, halogen (chlorine or bromine) or lower alkyl ($C_2$–$C_3$), methyl or ethyl benzoate, methyl or ethyl. In general, however, the use of diffusion-resistant developing retarders is to be preferred because the layer build-up, especially the build-up of materials having a multiplicity of colour layers and emulsion layers, is thereby substantially simplified. The developing retarders are used in amounts of 1 to 80 millimols, preferably of 3 to 40 millimols, per mol of silver in the pre-fogged emulsion.

The fogging of the core of a core-shell particle is carried out by customary methods, for example by diffuse exposure or using the conventional chemical agents, for example thiourea dioxide, tin(II) chloride, hydrazine, boranes, formaldehyde-sulfoxylates, or gold salts (complexes). Because the fogged cores are not intended to develop too rapidly, they are preferably produced using silver bromide. Lower proportions of up to about 20 mol percent of silver chloride can be used; higher proportions of silver chloride can in general develop too rapidly. The proportion of silver iodide should only be low and should not exceed about 1.0 mol percent, because the influence, used in the process according to the invention, on the developing by migrating iodide ions would not otherwise be ensured.

If the surface of the core is also treated with a developing retarder, this treatment is advantageously carried out after fogging, but still before growing the shell.

The processes taking place in the exposure and subsequent processing of the photographic material may be illustrated with the aid of the following experimental procedure (c.f. FIG. 1), using two image dyes. A material which, on a transparent base, has the following layers, in succession from bottom to top, is used for this purpose:

1. A gelatin layer containing a bleachable magenta-coloured azo dye and green-sensitised silver bromoiodide.

2. An intermediate gelatin layer.

3. A pre-fogged, spontaneously developable core-shell emulsion containing a developing retarder.

4. A gelatin layer containing a bleachable yellow azo dye.

If a material of this type is now exposed behind a grey wedge, subsequently developed and further processed in the customary manner (dye bleaching and silver bleaching and fixing) with known treatment baths, the following processes take place (FIG. 1):

(A) Unexposed areas (maximum density of the copying wedge)

The fogged emulsion (3) develops spontaneously to the maximum density; the green-sensitised emulsion (1) remains unexposed and develops only to the fogging level ($A_2$). Consequently, the yellow layer (4) associated with the pre-fogged emulsion is virtually completely bleached out and the magenta layer remains unattacked ($A_3$).

(B) Exposure with blue light

Because the yellow dye layer (4) is opaque to blue light, the green-sensitised emulsion layer (1) associated with the magenta layer is not exposed. The situation remains the same as under (A), i.e. the yellow layer (4) is bleached out to the maximum extent, whilst the magenta layer (1) remains wholly preserved ($B_3$).

(C) Exposure with green or white light

The green-sensitive emulsion (1) is exposed stepwise according to the wedge. On developing ($C_2$), iodide ions are formed proportionally to the exposure which has taken place, and they diffuse into the superposed pre-fogged emulsion layer (3) and inhibit the spontaneous exposure-independent developing in the latter. A silver image (3), which is the counter-image of the image in the lower emulsion layer, is thus formed in this layer (3). After the colour bleaching and silver bleaching ($C_3$), a dye image identical to the original remains in the magenta layer (1) and a dye counter-image remains in the yellow layer (4).

The experiment described above serves to demonstrate the mode of action of the arrangement. In practice, of course, the thickness and silver halide concentration of the pre-fogged emulsion layer will be adjusted so that, even in the maximum case, i.e. in the case of a completely unexposed lower emulsion layer, only that part of the yellow layer is bleached out which corresponds to the maximum secondary colour density in the blue of the unbleached magenta layer.

In particular, use is also made of photographic silver dye bleach materials in which the optical density of at least one image dye layer, the main colour density of which corresponds to the secondary colour density to be compensated, of another layer, is increased by an amount which compensates the density loss after processing in the unexposed or blue-exposed condition.

It is easy to understand that a number of different masking effects can be achieved by the process described. Depending on the arrangement of the layers in the whole layer assembly, it is thereby possible to mask one or two secondary colour densities of one dye or one secondary colour density of each of two dyes. The table (FIG. 2) shows the possible layer arrangements and combinations which lead to the different masking effects.

The diagram of the layer arrangement only shows the general case in which the dye and the associated emulsion sensitised in the complementary colour of the primary colur are located in the same layer. Of course, these combined components can also be distributed over two or even three different layers adjacent to one another. Layer arrangements of this type have been described, for example, in German Offenlegungsschriften No. 2,036,918, 2,132,835 and 2,132,836. In particular, they are used to influence the gradation, which is relatively steep in the case of silver dye bleach materials, or also increase the sensitivity.

A silver halide emulsion which is associated with a dye layer is to be understood as meaning an emulsion which, after exposure and developing, produces a silver image which, in the subsequent dye bleach process, produces a dye counter-image in the associated dye layer in a knowm manner. Usually, the emulsion is in this case spectrally sensitised so that its sensitivity maximum corresponds to the absorption maximum of the associated image dye (is sensitive in the region of the complementary colour of the image dye). From three such dye/emulsion pairs, it is then possible, in a known manner, to produce a trichromatic material with which the entire visible colour spectrum can be reproduced. However, it is also possible to sensitise an emulsion, associted with a dye, in another spectral region, as is customary, for example, in infrared-sensitive false colour films.

The sensitised silver halide emulsions assocaited with the individual image dyes can be located in the same layer as the corresonding image dyes or partially in a layer adjacent to the dye layer.

Adjacent layers to be understood as meaning those layers which, by virtue of their mutual position, favour the exchange of chemical species, namely molecules or ions. The concept thus also embraces those layers which are not directly adjacent, but are separated from one another, optionally by one or more thin layers which do not prevent diffusion.

Silver dye bleach materials for the reproduction of colour originals are generally trichromatic and contain three colour layers, namely one in each of the subtractive primary colours yellow, magenta and cyan. However, to achieve special effects, materials with other colours or with only two colour layers can also be used. Moreover, the yellow, magenta and cyan dyes known per se for this purpose can be used as image dyes, in combination with the appropriate spectral sensitisers.

Bleachable dyes which are suitable for the production of dye-containing silver halide emulsions for the silver dye bleach material are described, for example, in U.S. Pat. Nos. 3,454,402, 3,443,953, 3,804,630, 3,716,368, 3,877,949, 3,623,874, 3,931,142 and 4,051,123.

The material can additionally have layers in which at least one of the two components consisting of image dye and silver halide is at least partially absent.

The light-sensitive silver halide emulsions which are normally used are those which contain silver chloride, bromide or iodide or mixtures of these halides. Iodide-containing silver halide emulsions normally contain between 0.1 and 10, preferably 1 to 5, mol percent of silver iodide, the remainder consisting of silver chloride and/or bromde (for example 0 to 99.9 mole percent of silver chloride and 0 to 99.9 mol percent of silver bromide). Iodide-free silver halide emulsions preferably contain silver chloride, silver bromide or a silver chloride/silver bromide mixture.

To produce these emulsions, gelatin is customarily used as a protective colloid; however, other water-soluble protective colloids, such as polyvinyl alcohol or polyvinylpyrrolidone or the like, can also be used; furthermore, part of the gelatin can be replaced by dispersions of water-insoluble high-molecular substances. It is common, for example, to use dispersion polymers consisting of $\alpha,\beta$-unsaturated compounds, such as acrylic acid esters, vinyl esters and ethers, vinyl chloride and vinylidene chloride, and also consisting of other mixtures and copolymers.

Intermediate layers (barrier layers or separating layers (generally contain only pure binder, for example gelatin, and do not contain any dye which contributes to the formation of a colour image, or any silver halide. If it is advantageous for the total layer assembly, however, it is optionally also possible, for an emulsion layer already present or a filter layer to be used as a separating layer. Apart from the gelatin, the separating layer can contain further additives, such as substances which inhibit dye bleaching, additional binders, for example water-soluble colloids or water-soluble dispersion polymers, and also the customary additives for the assembly of the other photographic layers, such as plasticisers, wetting agents, light stabilisers, filter dyes or hardeners.

The emulsions can be applied to customary layer bases for photographic recording material. Optionally a mixture of several colloids can be used for dispersing the silver halides.

The base can consist, for example, of cellulose triacetate or polyester, which can be pigmented. If it consists of paper felt, this must be varnished on both sides or coated with polyethylene. The light-sensitive layers are located on at least one side of this base, preferably in the known arrangement, i.e. undermost a red-sensitised silver halide emulsion layer ccntaining a cyano azo dye, over this a green-sensitised silver halide emulsion layer containing a magenta-coloured azo dye, and uppermost a blue-sensitive silver halide emulsion layer containing a yellow azo dye. The material can also contain subbing layers, intermediate layers, filter layers and protective layers. The total thickness of the layers in the dry state should not as a rule exceed 20 $\mu$.

The processing of the exposed silver dye bleach materials is carried out in the conventional manner and comprises silver developing, dye bleaching, silver bleaching and fixing and then washing, it also being possible for the washing to take place between the inividual steps (c.f., for example, German Offenlegungsschrift No. 2,448,443). The dye bleaching and the silver bleaching, and optionally also the fixing, can be combined in a single treatment step.

For silver developing, it is possible to use baths of conventional composition, for example baths which contain hydroquinone as the developer substance, optionally in addition thereto 1-phenyl-3-pyrazolidone, but no silver-complexing agent. Moreover, it can be advantageous if the silver developing bath, as described in Swiss Pat. No. 405,929, additionally contains a dye bleach catalyst.

If the dye bleaching is carried out as a separate treatment step, the dye bleach baths used advantageously contain a dye bleach catalyst in addition to a strong acid, a water-soluble iodide and an antioxidant for the iodide. Combined dye bleach and silver bleach baths as a rule also contain a water-soluble oxidising agent in addition to the comonents indicated. Suitable dye bleach catalysts are rimarily diazone compounds, for example derivatives of pyrazine, quinoxaline or phenazine. They are described, for example, in German Auslegeschriften Nos. 2,010,280, 2,144,298 and 2,144,297, in French Pat. No. 1,489,460, in U.S. Pat. No. 2,270,118 and also in German Offenlegungsschrift No. 2,448,442.

Strong acids are to be understood here as meaning acids which impart a pH value of at most 2 to the dye bleach bath or combined dye bleach and silver bleach bath. Thus, for example, it is possible to use hydrochloric acid, phosphoric acid and especially sulfuric acid or sulfamic acid.

Alkali metal iodides, for example potassium iodide or sodium iodide, can be used as the water-soluble iodide.

Suitable oxidising agents are nitroso compounds, for example p-nitrosodimethylaniline, and nitro compounds, for example aromatic nitro compounds and preferably aromatic mono- or di-nitrobenensulfonic acids, for example m-nitrobenzenesulfonic acid.

The antioxidants used are advantageously reductones or water-soluble mercapto compounds. Suitabel reductones are, in particular, aci-reductones which have a 3-carbonylene-1,2-diol grouping, such as reduction, triose-reductone or, preferably, ascorbic acid.

Possible mercapto compounds are those of the formula $HSA(B)_m$, in which A is an aliphatic, cycloaliphatic, araliphatic, aromatic or heterocyclic bridge member, B is a water-solubilising radical and m is an integer of at most 4 (German Offenlegungsschriften Nos. 2,258,076 and 2,423,819).

The silver fixing bath can be made in a known and conventional manner. A suitable fixing agent is, for example, sodium thiosulfate or, advantageously, ammonia thiosulfate, optionally together with additives such as sodium bisulfite, sodium methabisulfite and/or ammonium bisulfite, and optionally a complexing agent such as ethylenediaminetetraacetic acid.

All treatment baths can contain further conventional additives, for example hardeners, wetting agents, fluorescent brighteners or UV stabilisers.

In the following examples, parts and percentages are by weight, unless states otherwise.

EXAMPLE 1

The following layers are successively coated ontoa white-opaque base:

(a) a green-sensitised silver iodide/bromide gelatin emulsion layer (97.5 mol % of AgBr and 2.5 mol % of AgI) with a silver content of 0.2 g/m$^2$, which contains 0.13 g/m$^2$ of the magenta-coloured azo dye of the formula

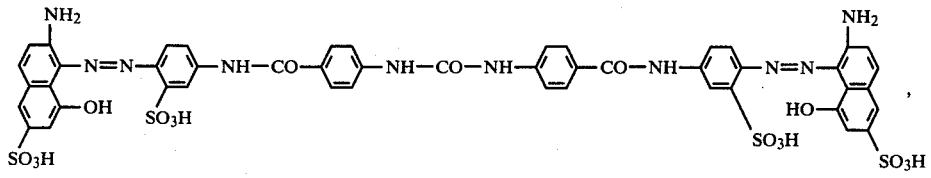

(101)

(b) a gelatin intermediate layer with an application weight of 5 g/m$^2$ of gelatin, and (c) a chemically fogged core-shell emulsion treated with a developing retarder, with a silver content of 0.2 g/m$^2$. 0.15 g/m$^2$ of a yellow bleachable azo dye of the formula

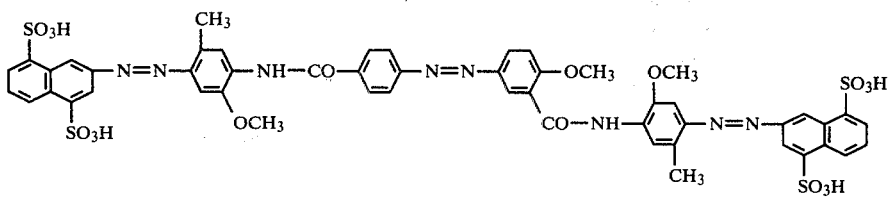

(102)

is also added to this layer.

The emulsion used in this layer is produced as follows:

A cubic-monodisperse silver bromide emulsion (edge length of the crystals: 0.55μ) is chemically fogged, for one hour at 60° C., with a solution of 0.01% of sodium formaldehyde-sulfoxylate ($HOCH_2SO_2Na.2H_2O$) and 0.001% of chlorauric acid ($HAuCl_4$). The emulsion fogged in this way is inhibited by adding 3 mg of 1-phenyl-5-mercaptotetrazole per g of silver, in the form of a 1% solution. A 0.02μ thick silver bromide shell is then precipitated onto the silver bromide crystals treated in this way. In place of the 1-phenyl-5-mercaptotetrazole, it is also possible to use developing retarders such as benzotriazole, 2-mercaptobenzothiazole or triazoindolizine.

A sample of the material coated in this way is exposed with green light through a step wedge and processed as follows:

| | |
|---|---|
| (a) Developing | 2½ minutes at 30° C. |
| Potassium sulfite | 2.0 g |
| Boric acid | 2.2 g |
| Hydroquinone | 14.9 g |
| Sodium formaldehyde-bisulfite | 44.0 g |
| Diethylenetriaminepentaacetic acid | 4.6 g |
| Potassium carbonate | 49.6 g |
| Potassium hydroxide | 0.74 g |
| Potassium bromide | 2.0 g |
| Diethanolamine | 12.9 g |
| Iso-ascorbic acid | 1.5 g |
| Triethylene glycol | 33.5 g |
| Water to | 1 liter |
| (b) Combined dye bleach and silver bleach bath | 3 minutes at 30° C. |
| Sulfuric acid (96%) | 40 g |
| Sodium 3-nitrobenzenesulfonate | 6 g |
| Potassium iodide | 8 g |
| 2,3,6-Trimethylquinoxaline | 2 g |
| Acetic acid (100%) | 2.1 g |
| 3-Mercaptobutyric acid | 1.75 g |
| Ethylene glycol monoethyl ether | 46.7 g |
| Water to | 1 liter |
| (c) Fixing bath | 3 minutes at 30° C. |
| Ammonium thiosulfate (98%) | 200 g |
| Potassium metabisulfite | 25 g |
| Potassium hydroxide (85%) | 11 g |
| Water to | 1 liter |

The material ils finally washed.

After this, the processed copy shows a positive magenta image identical to the exposure wedge, on which a yellow image which decreases counter-imagewise is superimposed. The measured analytical colour densities are reproduced in the following Table 1. They show the behaviour of the material according to the invention.

TABLE 1

| Density of original | Magenta image Green density = 570 nm λmax. | Yellow image Blue density = 420 nm λmax. |
|---|---|---|
| 0 | 0.02 | 2.50 |
| 0.15 | 0.02 | 2.44 |
| 0.3 | 0.04 | 2.55 |
| 0.45 | 0.06 | 2.54 |
| 0.6 | 0.08 | 2.32 |
| 0.75 | 0.17 | 2.16 |
| 0.9 | 0.31 | 2.12 |
| 1.05 | 0.65 | 2.17 |
| 1.2 | 0.95 | 2.10 |
| 1.35 | 1.34 | 2.14 |
| 1.5 | 1.83 | 2.14 |
| 1.65 | 2.12 | 2.13 |

EXAMPLE 2

A photographic material with three layers is produced on an opaque base in a manner similar to Example 1:

(a) a green-sensitised gelatin silver iodobromide emulsion layer (95 mol % of silver bromide and 5 mol % of silver iodide) with a silver content of 0.2 g/m², which contains 0.13 g/m² of the magenta dye of the formula (101), (b) a gelatin intermediate layer with an application weight of 5 g/m², and (c) a chemically fogged core-shell emulsion treated with a developing retarder, with a silver content of 0.2 g/m². 0.15 g of the bleachable yellow azo dye of the formula (102) is also added to the layer.

The core-shell emulsion is produced in the same manner as in Example 1; the edge length of the cubic silver halide crystals is 0.9μ; the following two variants are chosen for the production of the crystal shells - A: shell thickness of 0.01μ, and B: shell thickness of 0.02μ.

A sample of each variant is exposed with green light through a step wedge and processed as follows:

(a) Developing—3 minutes at 30° C.

The developing bath is the same as that in Example 1, but additionally contains 40 g of sodium sulfite per liter.

(b) Combined dye bleaching and silver bleaching—3 minutes at 30° C.

The composition is the same as that in Example 1.

(c) Fixing bath—3 minutes at 30° C.

The composition is the same as that in Example 1.

As shown in the following Table 2, the intermediate image effect, measured against the gradation of the yellow counter-image, can be strongly influenced by suitably choosing the shell thickness of the fogged core-shell emulsion.

TABLE 2

Varying shell thickness of the core-shell emulsion
Influence on the intermediate image effect
A: shell thickness of 0.01μ
B: shell thickness of 0.02μ
Analytical densities

| Density of original (Step wedge) | Magenta image Green density = 570 nm λmax. A | B | Yellow image Blue density = 420 nm λmax. A | B |
|---|---|---|---|---|
| 0 | 0.49 | 0.32 | 3.19 | 3.32 |
| 0.3 | 0.90 | 0.68 | 3.12 | 3.33 |
| 0.6 | 1.38 | 1.18 | 2.31 | 3.29 |
| 0.9 | 1.86 | 1.82 | 0.84 | 3.10 |
| 1.2 | 2.11 | 2.16 | 0.25 | 2.66 |
| 1.5 | 2.18 | 2.23 | 0.13 | 2.43 |
| 1.8 | 2.20 | 2.24 | 0.13 | 2.68 |
| 2.1 | 2.20 | 2.25 | 0.05 | 2.66 |
| 2.4 | 2.17 | 2.26 | 0.01 | 2.62 |

EXAMPLE 3

This example relates to a photographic material according to the present invention, into the layers of which hydroquinone is incorporated as a developer in a concentration of 1 g/m$^2$.

The material is produced in the manner described in Example 1, but an emulsion of 95 mol % of silver bromide and 5 mol % of silver iodide is used for the layer a).

After exposure with green light through a step wedge, an activating bath of the following composition is used in place of a developer:

| Activating bath | |
|---|---|
| Diethylaminoethanol | 80 g |
| Methylaminoethanol | 20 g |
| Sodium sulfite | 10 g |
| Water to | 1 liter |

The further processing, consisting of combined dye bleaching and silver bleaching, fixing and final washing, is carried out as in Example 1.

The processed material shows a magenta image identical to the exposure wedge and a density of the yellow dye which increases counter-imagewise thereto.

The evaluation gives the following sensitometric data in analytical densities:

TABLE 3

| Density of original | Magenta image Green density = 570 nm λmax. | Yellow image Blue density = 420 nm λmax. |
|---|---|---|
| 0 | 0.04 | 2.66 |
| 0.3 | 0.16 | 2.56 |
| 0.6 | 0.46 | 2.31 |
| 0.9 | 0.97 | 1.57 |
| 1.2 | 1.39 | 1.23 |
| 1.5 | 1.67 | 0.82 |
| 1.8 | 1.86 | 0.71 |
| 2.1 | 1.93 | 0.65 |
| 2.4 | 1.93 | 0.70 |

EXAMPLE 4

This example illustrates the developing kinetics in the core-shell emulsion as a function of the sulfite content of the developer.

As in Example 2, a photographic material with three layers is produced on an opaque base, but a coreshell emulsion is used, the cubic crystals of which have an edge length of 0.55μ and an AgBr shell thickness of 0.015μ. 6 mg of 1-phenyl-5-mercaptotetrazole per g of silver are used as the developing retarder.

4 samples of this material are exposed with green light through a step wedge and processed as follows:

| | |
|---|---|
| (a) Developing | 3 minutes at 40° C. |
| Sample A: | Developing bath as in Example 1 (potassium sulfite: 2 g/liter) |
| Sample B: | Additionally 10 g/liter of sodium sulfite |
| Sample C: | Additionally 20 g/liter of sodium sulfite |
| Sample D: | Additionally 40 g/liter of sodium sulfite |
| (b) Combined dye bleach and silver bleach bath | 3 minutes at 30° C. |
| The composition is the same as in Example 1. | |
| (c) Fixing bath | 3 minutes at 30° C. |

The composition is the same as in Example 1.

As shown in the following Table 4, the counter-gradation of the yellow image can be influenced by the sulfite content of the developer. The numerical values in the table represent analytical densities at the indicated wavelength.

TABLE 4

| Density of original | Magenta image Green density = 570 nm λmax. A | B | C | D | Yellow image Blue density = 420 nm λmax. A | B | C | D |
|---|---|---|---|---|---|---|---|---|
| 0 | 0.04 | 0.07 | 0.06 | 0.08 | 3.33 | 3.42 | 3.50 | 3.54 |
| 0.3 | 0.09 | 0.20 | 0.26 | 0.17 | 3.32 | 3.63 | 3.66 | 3.73 |
| 0.6 | 0.32 | 0.52 | 0.81 | 0.60 | 0.10 | 3.02 | 3.74 | 3.79 |
| 0.9 | 0.79 | 0.76 | 1.00 | 1.16 | 0.06 | 0.07 | 0.08 | 2.52 |
| 1.2 | 1.13 | 1.40 | 1.34 | 1.25 | 0.04 | 0.04 | 0.07 | 0.12 |
| 1.5 | 1.31 | 1.61 | 1.50 | 1.58 | 0.04 | 0.02 | 0.09 | 0.10 |
| 1.8 | 1.44 | 1.66 | 1.59 | 1.72 | 0.02 | 0.02 | 0.10 | 0.09 |
| 2.1 | 1.44 | 1.66 | 1.66 | 1.73 | 0.03 | 0.03 | 0.05 | 0.09 |
| 2.4 | 1.44 | 1.66 | 1.66 | 1.73 | 0.04 | 0.05 | 0.06 | 0.12 |

It can be inferred from Table 4 that the maximum density of the magenta image increases to some extent with increasing sulfite concentration, whilst at the same time the gradation of the yellow counter-image is distinctly flattened.

EXAMPLE 5

This example relates to the masking of the blue secondary colour density of a magenta dye in photographic (tripack) material. The following layers are successively coated onto a white-opaque base:

(a) a red-sensitised silver iodide/bromide gelatin emulsion layer with 97.4 mol % of AgBr and 2.6 mol % of AgI and a silver content of 0.17 g/m$^2$, which contains 0.13 g/m$^2$ of the cyan dye of the formula

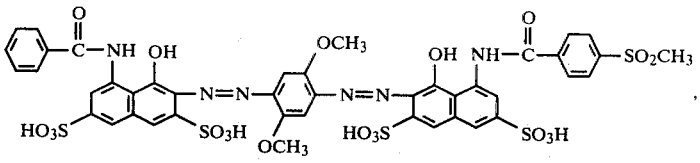

(103)

(b) a gelatin intermediate layer with an application weight of 1.52 g/m², which contains 0.42 g/m² of a (blocked) hydroquinone derivative of the formula

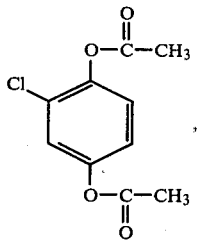

(104)

(c) a green-sensitised silver iodide/bromide gelatin emulsion layer with 95 mol % of silver bromide, 5 mol % of silver iodide and a silver content of 0.22 g/m², which contains 0.154 g/m² of the magenta dye of the formula (101), (d) a yellow filter layer which contains 1.68 g/m² of gelatin, 0.04 g/m² of colloidal silver, 0.05 g/m² of the yellow dye of the formula (102) and 0.72 g/m² of the hydroquinone derivative of the formula (104), (e) a chemically fogged core-shell emulsion with a silver content of 0.1 g/m² (which is produced as follows: a cubic-monodisperse silver bromide emulsion (edge length of the crystals: 0.59μ) is fogged, for 1 hour at 60° C., with a solution of 0.01% of formamidinesulfinic acid and 0.01% of chloroauric acid and then coated with a 0.025μ thick silver bromide shell), (f) a blue-sensitive silver bromide gelatin emulsion layer with a silver content of 0.36 g/m², which contains 0.11 g/m² of the yellow dye of the formula (102), and (g) a gelatin protective layer with a coating weight of 1.16 g/m².

In each case one sample of this material is exposed through a step wedge (A) polychromatically, (B) with blue light and (C) with green light, and processed as follows:

| | |
|---|---|
| (a) Activating bath | 1 minute at 30° C. |
| Potassium hydroxide | 9.0 g |
| Sodium sulfite | 25.0 g |
| Potassium carbonate | 69.0 g |
| Water to | 1 liter |
| (b) Washing | ½ minute at 30° C. |
| (c) Combined dye bleach and silver bleach bath | 3 minutes at 30° C. |
| Sulfuric acid (96%) | 40 g |
| Sodium 3-nitrobenzenesulfonate | 6 g |
| Potassium iodide | 8 g |
| 2,3,6-trimethylquinoxaline | 2 g |
| Acetic acid (100%) | 2.1 g |
| 3-Mercaptobutyric acid | 1.75 g |
| Ethylene glycol monoethyl ether | 46.7 g |
| Water to | 1 liter |
| (d) Fixing bath | 3 minutes at 30° C. |
| Ammonium thiosulfate (98%) | 200 g |
| Potassium metabisulfite | 25 g |
| Potassium hydroxide (85%) | 11 g |
| Water to | 1 liter |

-continued

| |
|---|
| (e) Final washing |

Figure 3:
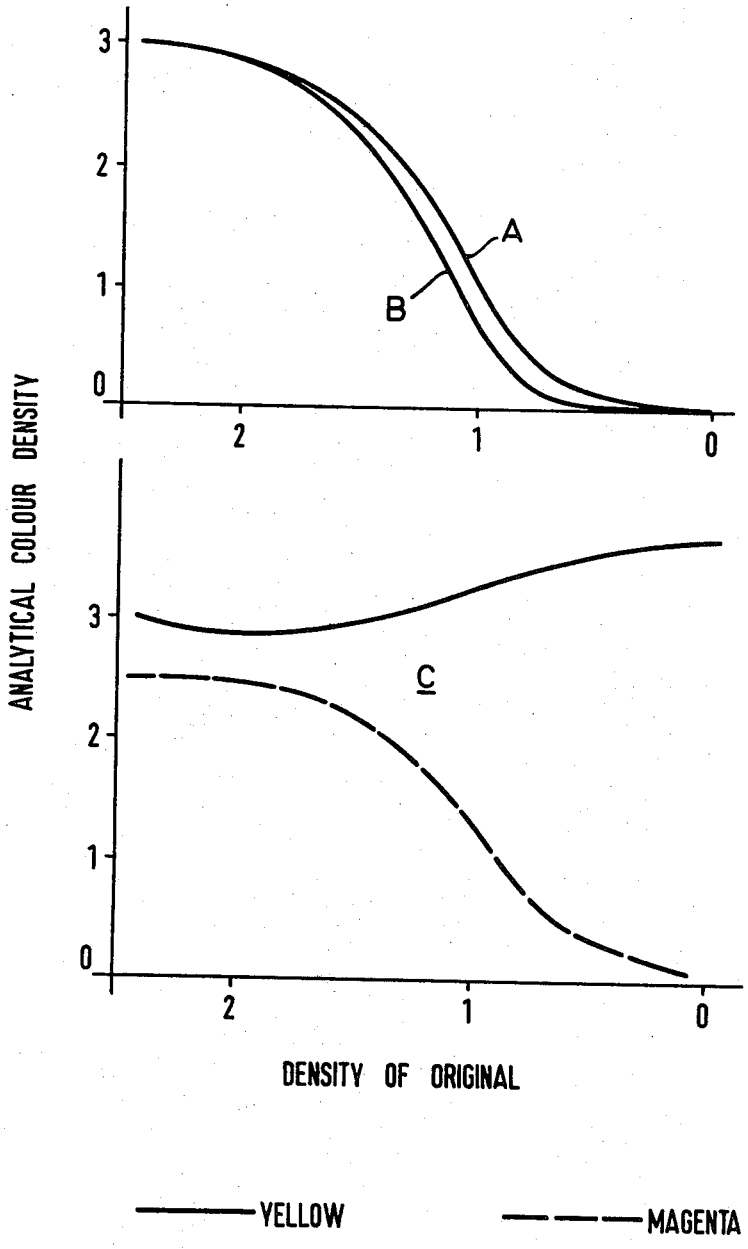

The analytical densities of the resulting colour wedge are measured. The results are summarised in FIG. 3 in the form of D/log E curves.

In the case of an advantageous intermediate image effect—for the masking of the blue secondary colour density of the magenta dye—curve A (polychromatic exposure) diverges from curve B (blue exposure), i.e. over a relatively large density range of the original, a higher yellow density is obtained in the case of polychromatic exposure than in the case of blue exposure.

This intermediate image effect is also present in the case of green exposure (curve C). In this case, the copy shows a magenta density which decreases imagewise to the exposure wedge and a yellow density which increases counter-imagewise thereto.

What is claimed is:

1. A process for the production of masked positive colour images by the silver dye bleach process, by exposure of a photographic material for the silver dye bleach process, silver developing, dye bleaching, silver bleaching and fixing, the silver bleaching being optionally carried out simultaneously with the dye bleaching and/or the fixing, in a single processing bath, in which process the photographic material contains (a) in at least one layer, at least one first dye from which at least one undesired secondary colour density is to be compensated, (b) in the layer(s) (a) and/or in a layer adjacent to this layer, (in each case) one iodide-containing silver halide emulsion associated with this dye (these dyes), (c) in at least one other layer, at least (in each case) one second dye, the main colour density of which corresponds to the secondary colour density (densities), to be compensated, of the first dye(s), (d) in the layer(s) (c) and/or in a layer adjacent thereto, an iodide-free silver halide emulsion associated with this dye (these dyes), or, in comparison with the emulsions mentioned under (b) a silver halide emulsion of low iodide content, and (e) in the layer(s) (c) and/or in at least one other layer which is adjacent to the layer(s) (c) and which is separated from one or more layers (a) by at least one intermediate layer, a core-shell emulsion which is free of iodide or has a low iodide content, the particles of which emulsion consist of a surface-fogged silver halide core and of an unfogged silver halide shell enclosing the latter, it being possible for this emulsion to be developed spontaneously up to the maximum density by the action of a developer, and optionally a developing retarder, and the developing is carried out in a developer solution which is free of silver-complexing agents.

2. A process according to claim 1, wherein the core of a core-shell particle consists of silver bromide or silver chlorobromide with a content of at most 20 mol % of silver chloride and at most 1.0 mol % of silver iodide, and is fogged, before the shell is applied, by prior exposure or by chemical treatment.

3. A process according to claim 1, wherein the shell of a core-fogged core-shell particle consists of an unfogged silver halide and has a thickness of between 50 and 1,000 Å, preferably of between 100 and 250 Å.

4. A process according to claim 1, wherein the shell of the core-fogged core-shell particle consists of the same silver halide as the core or of a different silver halide.

5. A process according to claim 1, wherein, after the fogging, but before the application of the shell, the silver halide crystal is treated, optionally with a developing retarder.

6. A process according to claim 5, wherein the developing retarder used is a 5-mercaptotetrazole substituted in the 1-position by an alkyl, aryl or aralkyl group.

7. A process according to claim 6, wherein the developing retarder used is a 5-mercaptotetrazole substituted in the 1-position by alkyl having at least 3 carbon atoms, aryl having at least 2 nuclei or aralkyl having at least 3 carbon atoms in the alkyl moiety.

8. A process according to claim 5, wherein the developing retarder is used in amounts of 1 to 80, preferably of 3 to 40, millimols per mol of silver in the pre-fogged emulsion.

9. A process according to claim 1, wherein at least one intermediate layer, which contains neither image dye nor silver halide, is arranged in the photographic material between the layer (e), which contains the pre-fogged core-shell emulsion, and the layer (b), which contains an iodide-containing silver halide emulsion.

10. A process according to claim 1, wherein the silver halide emulsions associated with the image dyes show spectral sensitivities in the respective complementary colour of the image dye.

11. A process according to claim 1, wherein the silver halide emulsions associated with the image dyes show different spectral sensitivities from those in the respective complementary colour.

12. A process according to claim 1, wherein the photographic material has additional layers in which at least one of the two components consisting of image dye and silver halide is at least partially absent.

13. A process according to claim 1, wherein a trichromatic material is used which contains, as the image dye, a cyan dye, a magenta dye and a yellow dye, there being one in each layer.

14. A process according to claim 1, wherein the sensitised silver halide emulsions associated with the individual image dyes are located in the same layer as the corresponding image dyes or partially in a layer adjacent to the dye layer.

15. A process according to claim 1, wherein one or two secondary colour densities of one image dye in a multilayer material are compensated.

16. A process according to claim 1, wherein one secondary colour density of each of two image dyes in a multilayer material is compensated.

17. A process according to claim 1, wherein the silver iodide-free emulsion layers associated with a dye contain silver chloride or bromide or a mixture of both halides.

18. A process according to claim 1, wherein the silver iodide-containing emulsions contain 0 to 99.9 mol % of silver chloride, 0 to 99.9 mol % of silver bromide and 0.1 to 10, preferably 1 to 5, mol % of silver iodide.

19. a process according to claim 1, wherein 2 to 100 g of an alkali metal sulfite or ammonium sulfite per liter of developer solution are used in the developer in order to control the developing kinetics.

20. A photographic silver dye bleach material for the production of masked positive colour images, which contains (a) in at least one layer, at least one first dye from which at least one undesired secondary colour density is to be compensated, (b) in the layer(s) (a) and/or in a layer adjacent to this layer, (in each case) one iodide-containing silver halide emulsion associated with this dye (these dyes), (c) in at least one other layer, at least (in each case) one second dye, the main colour density of which corresponds to the secondary colour density (densities), to be compensated, of the first dye(s).

(d) in the layer(s) (c) and/or in a layer adjacent thereto, an iodide-free silver halide emulsion associated with this dye (these dyes), or, in comparison with the emulsions mentioned under (b), a silver halide emulsion of a low iodide content, and (e) in the layer(s) (c) and/or in at least one other layer which is adjacent to the layer(s) (c) and which is separated from one or more layers (a) by at least one intermediate layer, a core-shell emulsion which is free of iodide or has a low iodide content, the particles of which emulsion consist of a surface-fogged silver halide core and of an unfogged silver halide shell enclosing the latter, it being possible for this emulsion to be developed spontaneously up to the maximum density by the action of a developer, and optionally a developing retarder for further control of the developing kinetics.

21. A silver dye bleach material according to claim 20, wherein the optical density of at least one image dye layer, the main colour density of which corresponds to the layers, the main colour density of which corresponds to the secondary colour density, to be compensated, of another layer, is increased by an amount which compensates the density loss after processing in the unexposed condition.

* * * * *

UNITED STATES PATENT AND TRADEMARK OFFICE

CERTIFICATE OF CORRECTION

PATENT NO. : 4,368,256

DATED : Jan. 11, 1983

INVENTOR(S) : Herbert Mollet et al

It is certified that error appears in the above—identified patent and that said Letters Patent is hereby corrected as shown below:

Column 18, line 53, Delete "the layers, the main colour density, of which corresponds to".

Signed and Sealed this

*Twenty-ninth* Day of *March 1983*

[SEAL]

*Attest:*

GERALD J. MOSSINGHOFF

*Attesting Officer*

*Commissioner of Patents and Trademarks*